US009725270B2

(12) United States Patent
Newhouse et al.

(10) Patent No.: US 9,725,270 B2
(45) Date of Patent: Aug. 8, 2017

(54) CORRUGATED EDGE NIP

(71) Applicant: 3M INNOVATIVE PROPERTIES COMPANY, St. Paul, MN (US)

(72) Inventors: Kevin B. Newhouse, Houlton, WI (US); Bruce E. Tait, Woodbury, MN (US); Terence A. Lee, Decatur, AL (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/695,472

(22) Filed: Apr. 24, 2015

(65) Prior Publication Data

US 2015/0232294 A1 Aug. 20, 2015

Related U.S. Application Data

(62) Division of application No. 13/500,154, filed as application No. PCT/US2010/052137 on Oct. 11, 2010, now Pat. No. 9,038,879.

(60) Provisional application No. 61/251,007, filed on Oct. 13, 2009.

(51) Int. Cl.

| | |
|---|---|
| ***B65H 23/025*** | (2006.01) |
| ***B65H 20/02*** | (2006.01) |
| ***B65H 23/26*** | (2006.01) |
| ***B65H 27/00*** | (2006.01) |

(52) U.S. Cl.

CPC ..... *B65H 23/0256* (2013.01); *B65H 20/02* (2013.01); *B65H 23/26* (2013.01); *B65H 27/00* (2013.01); *B65H 2301/51214* (2013.01); *B65H 2404/1311* (2013.01); *B65H 2404/1317* (2013.01); *B65H 2404/1415* (2013.01); *B65H 2701/1315* (2013.01)

(58) Field of Classification Search

CPC .. B65H 23/025; B65H 23/0256; B65H 23/26; B65H 20/02; B65H 2404/1311; B65H 2404/1317; B65H 2301/51214; B65H 2701/1315

See application file for complete search history.

(56) References Cited

U.S. PATENT DOCUMENTS

| | | | |
|---|---|---|---|
| 3,046,823 A | 7/1962 | Cole | |
| 3,219,202 A | 11/1965 | Huffman | |
| 3,726,168 A | 4/1973 | Glanz et al. | |
| 3,741,085 A | 6/1973 | Sutton | |
| 3,750,512 A | 8/1973 | Gotham et al. | |
| 4,779,498 A | 10/1988 | Perkins | |
| 4,846,030 A | 7/1989 | McMahon et al. | |

(Continued)

FOREIGN PATENT DOCUMENTS

| | | | |
|---|---|---|---|
| DE | 4342341 C1 * | 10/1994 | ..... B29C 55/08 |
| DE | 19938165 A1 * | 2/2001 | ..... B65H 23/025 |

(Continued)

*Primary Examiner* — William E Dondero

(74) *Attorney, Agent, or Firm* — Robert H. Jordan

(57) ABSTRACT

A web tensioner, a web slitter, a method of tensioning a web, and a method of slitting a web are provided. A corrugated edge nip is used in the tensioner, the slitter, and the methods of tensioning and slitting. The corrugated edge nip can provide a crossweb tension to a suspended web or film in a web line. The corrugated edge nip can be used in conjunction with, for example, a rotary shear slitter to improve slit edge quality.

16 Claims, 6 Drawing Sheets

(56) References Cited

U.S. PATENT DOCUMENTS

| | | | |
|---|---|---|---|
| 5,143,679 | A | 9/1992 | Weber |
| 5,279,195 | A | 1/1994 | Breton |
| 5,732,609 | A | 3/1998 | Marschke |
| 5,740,709 | A | 4/1998 | Boston et al. |
| 6,001,198 | A | 12/1999 | Habisreitinger et al. |
| 6,419,138 | B1 | 7/2002 | Takahashi |
| 6,460,439 | B2 | 10/2002 | Belanger |
| 6,994,290 | B2 | 2/2006 | Ito |
| 2002/0132162 | A1 | 9/2002 | Takata et al. |
| 2008/0134856 | A1 | 6/2008 | Kawachi |

FOREIGN PATENT DOCUMENTS

| | | | | |
|---|---|---|---|---|
| DE | 102007000603 | A1 * | 5/2009 | ..... B65H 23/025 |
| GB | 744977 | | 2/1956 | |
| GB | 973422 | | 10/1964 | |
| JP | 59-048122 | | 3/1984 | |
| JP | 02-095656 | | 4/1990 | |
| JP | 3-237427 | | 10/1991 | |
| JP | 4-69188 | | 3/1992 | |
| JP | H06-320492 | | 11/1994 | |
| JP | H06320492 | | 11/1994 | |
| JP | 9-150395 | | 10/1997 | |
| JP | 11-114881 | | 4/1999 | |
| JP | 11-17693 | | 7/1999 | |
| JP | 2001-205622 | | 7/2001 | |
| JP | 2002-22199 | | 1/2002 | |
| JP | 2002-172585 | | 6/2002 | |
| JP | 2002-337088 | | 11/2002 | |
| JP | 2002-356254 | | 12/2002 | |
| JP | 2003-170389 | | 6/2003 | |
| JP | 2003-251587 | | 9/2003 | |
| JP | 2004-09240 | | 1/2004 | |
| JP | 2004-17210 | | 1/2004 | |
| JP | 2004-42205 | | 2/2004 | |
| JP | 2004-74321 | | 3/2004 | |
| JP | 2005-089143 | | 4/2005 | |
| JP | 2007-38564 | | 2/2007 | |
| JP | 2008-55793 | | 3/2008 | |
| KR | 10-2001-0027508 | | 4/2001 | |
| KR | 20-0336088 | | 11/2003 | |
| KR | 20-0388123 | | 6/2005 | |
| WO | WO 2006/129870 | | 12/2006 | |

* cited by examiner

CORRUGATED EDGE NIP

BACKGROUND

A web or film suspended between two idler rolls in currently available web lines can support tension in the direction of the moving web, but there are no adequate techniques to provide a crossweb tension to the suspended web. The inability to provide crossweb tension can cause problems in web processing, for example, current commercially available rotary shear slitting knife holders fail to stabilize web presentation for the shear slitting process. This can result in poor slit edge quality which can generate fine particle debris and also can create or propagate web breaks.

SUMMARY

In one aspect, the present disclosure provides a web tensioner that includes a tensioning plane having a center portion, a first edge portion, a second edge portion opposite the first edge portion, and a tensioning direction perpendicular to both the first edge portion and the second edge portion. The web tensioner further includes a first nip wheel having a first corrugated surface adjacent the first edge portion on a first surface of the tensioning plane. The web tensioner still further includes a second nip wheel having a second corrugated surface adjacent the first edge portion on a second surface of the tensioning plane opposite the first surface, wherein the first corrugated surface and the second corrugated surface at least partially intermesh.

In another aspect, the present disclosure provides a web slitter that includes a tensioning plane having a center portion, a first edge portion, a second edge portion opposite the first edge portion, and a tensioning direction perpendicular to both the first edge portion and the second edge portion. The web slitter further includes a first nip wheel having a first corrugated surface adjacent the first edge portion on a first surface of the tensioning plane. The web slitter still further includes a second nip wheel having a second corrugated surface adjacent the first edge portion on a second surface of the cutting plane opposite the first surface. The web slitter still further includes at least one cutting device disposed to cut the center portion, wherein the first corrugated surface and the second corrugated surface at least partially intermesh.

In another aspect, the present disclosure provides a method of applying lateral tension to a web that includes suspending a web moving in a downweb direction, the web having a center portion, a first edge portion, and a second edge portion opposite the first edge portion. The method of applying lateral tension to a web further includes positioning a first corrugated surface of a first nip wheel adjacent the first edge portion on a first surface of the web, the first nip wheel having a first axis. The method of applying lateral tension to a web still further includes positioning a second corrugated surface of a second nip wheel adjacent the first edge portion on a second surface of the web, the second nip wheel having a second axis parallel to the first axis. The method of applying lateral tension to a web still further includes positioning a third corrugated surface of a third nip wheel adjacent the second edge portion on the first surface of the web, the third nip wheel having a third axis. The method of applying lateral tension to a web still further includes positioning a fourth corrugated surface of a fourth nip wheel adjacent the second edge portion on the second surface of the web, the fourth nip wheel having a fourth axis parallel to the third axis. The method of applying lateral tension to a web still further includes driving at least one of the first nip wheel to rotate about the first axis and the second nip wheel to rotate about the second axis. The method of applying lateral tension to a web still further includes driving at least one of the third nip wheel to rotate about the third axis and the fourth nip wheel to rotate about the fourth axis. The method of applying lateral tension to a web still further includes intermeshing the first corrugated surface with the second corrugated surface and the third corrugated surface with the fourth corrugated surface, thereby applying a lateral tension to the center portion of the web.

In yet another aspect, the present disclosure provides a method of slitting a web that includes suspending a web moving in a downweb direction, the web having a center portion, a first edge portion, and a second edge portion opposite the first edge portion. The method of slitting a web further includes positioning a first corrugated surface of a first nip wheel adjacent the first edge portion on a first surface of the web, the first nip wheel having a first axis. The method of slitting a web still further includes positioning a second corrugated surface of a second nip wheel adjacent the first edge portion on a second surface of the web, the second nip wheel having a second axis parallel to the first axis. The method of slitting a web still further includes positioning a third corrugated surface of a third nip wheel adjacent the second edge portion on the first surface of the web, the third nip wheel having a third axis. The method of slitting a web still further includes positioning a fourth corrugated surface of a fourth nip wheel adjacent the second edge portion on the second surface of the web, the fourth nip wheel having a fourth axis parallel to the third axis. The method of slitting a web still further includes driving at least one of the first nip wheel to rotate about the first axis and the second nip wheel to rotate about the second axis. The method of slitting a web still further includes driving at least one of the third nip wheel to rotate about the third axis and the fourth nip wheel to rotate about the fourth axis. The method of slitting a web still further includes intermeshing the first corrugated surface with the second corrugated surface and the third corrugated surface with the fourth corrugated surface, thereby applying a lateral tension to the center portion of the web. The method of slitting a web still further includes positioning at least one cutting device to cut the web in the center portion.

BRIEF DESCRIPTION OF THE DRAWINGS

Throughout the specification reference is made to the appended drawings, where like reference numerals designate like elements, and wherein.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

This application describes a corrugated edge nip that can provide crossweb tension to a suspended web or film. The corrugated edge nip can be used in conjunction with, for example, a rotary shear slitter to improve slit edge quality. Generally, the corrugated edge nip wheels can perform several functions. The corrugated edge nip can nip the outer edge of the web next to shear slitting knives to stabilize the web presented to the shear slitter. The corrugated edge nip can also isolate the point of slitting from external forces including edge trim removal, drafts, static electricity, and the like. The corrugated edge nip can also provide crossweb tensioning and impart structural integrity to the resulting edge trim (weed), to aid in edge trim removal.

The corrugated edge nip can reduce web breaks by increasing web stability and edge quality during shear slitting. Stability improvements can result from crossweb tension generated by nipping the outer web edges. Nipping the outer web edge also isolates the point of slitting from external forces on the edge trim produced by the trim removal system. External forces on the edge trim can produce micro fractures in the slit edge, leading to web breaks. The corrugated nip wheel design not only reduces forces leading to web breaks, but it can also form a curved edge trim, thereby providing a downweb structure which can assist in edge trim removal.

Figure 1A:
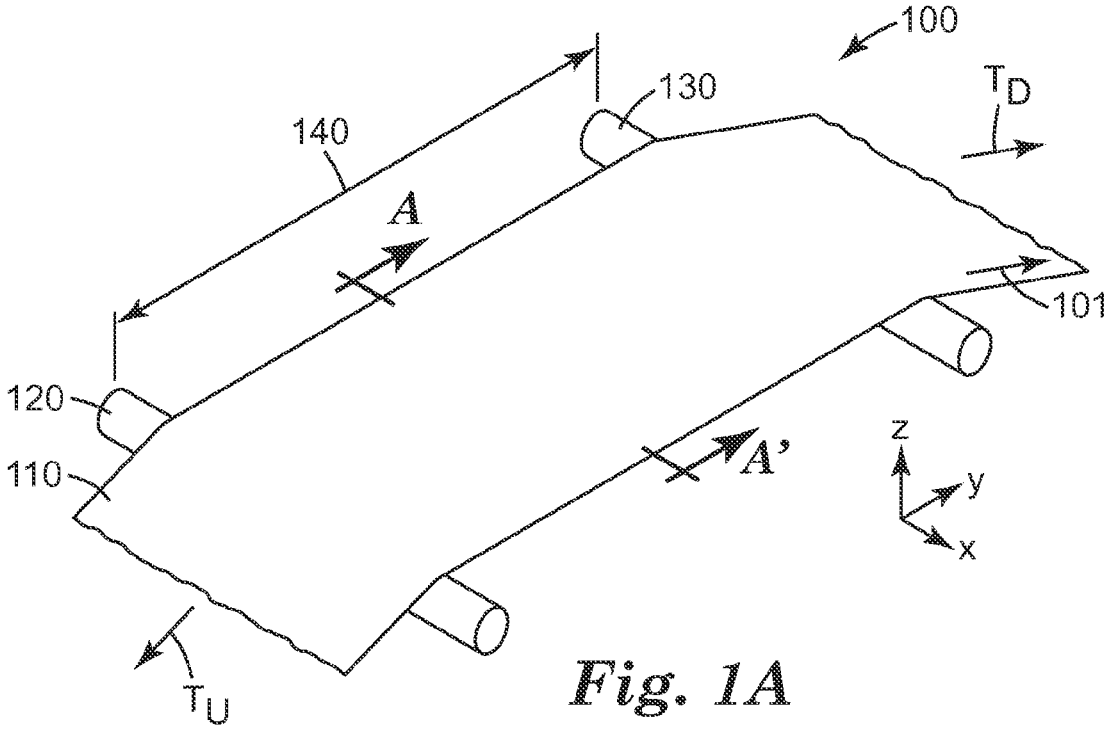
Fig. 1A PRIOR ART
FIG. 1A is a perspective schematic of a prior art web line.

FIG. 1A is a perspective schematic of a prior art web line 100 that includes a web 110 suspended over a region 140 between a first idler roll 120 and a second idler roll 130. Web 110 is shown to be moving in a downweb direction 101 (that is, in the "y" coordinate direction), and is kept taut in region 140 by an upweb tension $T_U$ and a downweb tension $T_D$.

Figure 1B:
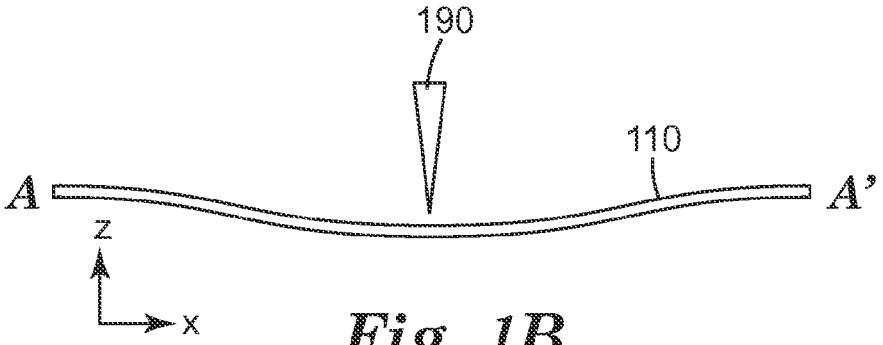
Fig. 1B PRIOR ART
FIG. 1B is a cross sectional schematic of a prior art web.

FIG. 1B is a cross sectional schematic of a prior art web 110 through the section A-A' within region 140 of FIG. 1A. In FIG. 1B, a slight "waviness" deformation in the web 110 is shown, representing the lack of cross-web (that is, in the "x" coordinate direction) tension in web 110. Since there is no applied crossweb tension within region 140, the web 110 can vary from a plane, and subsequent application of, for example, a knife edge 190, can cause further deformation of the web. This waviness or deformation can cause problems when attempting to accurately and cleanly cut the web, since the cut line is not well defined. In other words, the cut edge can be jagged with debris generation.

Figure 2:
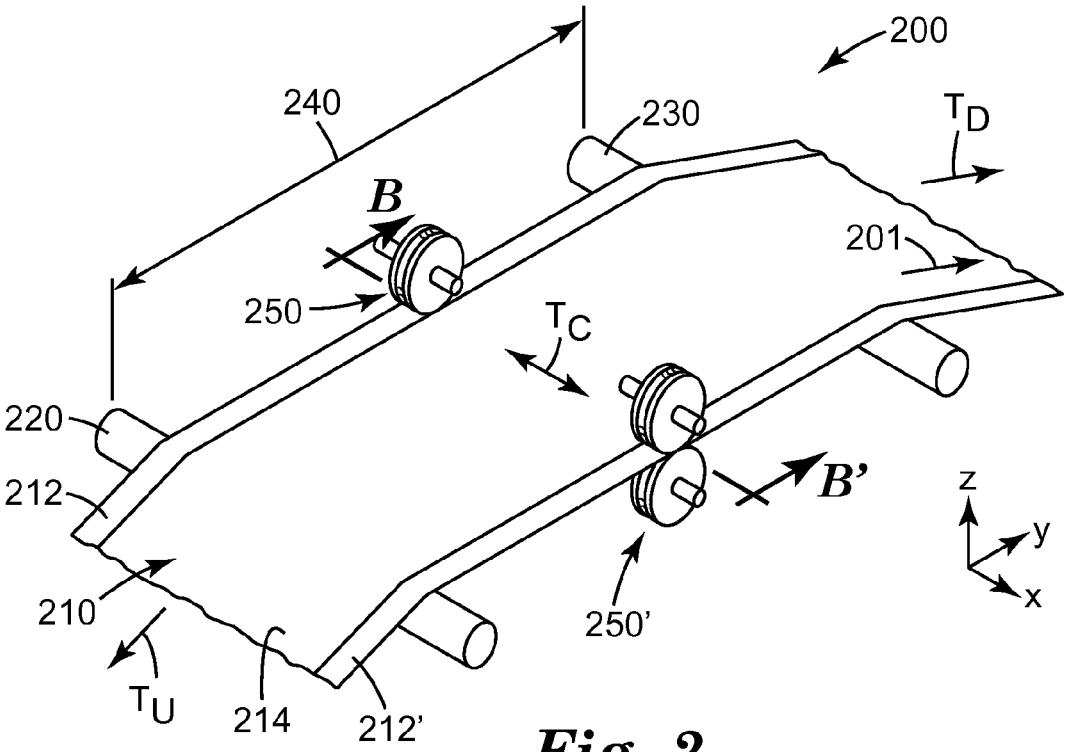
FIG. 2 is a perspective schematic of a web line.

FIG. 2 is a perspective schematic of a web line 200 according to one aspect of the disclosure. In FIG. 2, a web 210 is suspended over a region 240 between a first idler roll 220 and a second idler roll 230. Web 210 is shown to be moving in a downweb direction 201 (that is, in the "y" coordinate direction), and is kept taut in region 240, in part, by an upweb tension $T_U$ and a downweb tension $T_D$.

In one particular embodiment, web line 200 further includes a tensioning plane indicated by a crossweb tension $T_C$ in the "x" coordinate direction (that is, perpendicular to the first and second edge portions 212, 212'. The tensioning plane includes a web having a center portion 214, a first edge portion 212, and a second edge portion 212' opposite the first end portion 212. A first pair of nip wheels 250 is adjacent the first edge portion 212 of web 210, and a second pair of nip wheels is adjacent the second edge portion 212' of web 210. Each pair of nip wheels (250, 250') provide the crossweb tension $T_C$, as described elsewhere. In some cases (not shown), a single pair of nip wheels (either 250 or 250') on one of the edge portions (212 or 212' respectively) may provide sufficient crossweb tension to planarize the web 210. Crossweb tension from a single pair of nip wheels may be sufficient, for example, when the web 210 can be prevented from sliding across the first and second idler rolls 220, 230, in the x coordinate direction, as described elsewhere.

Figure 3:
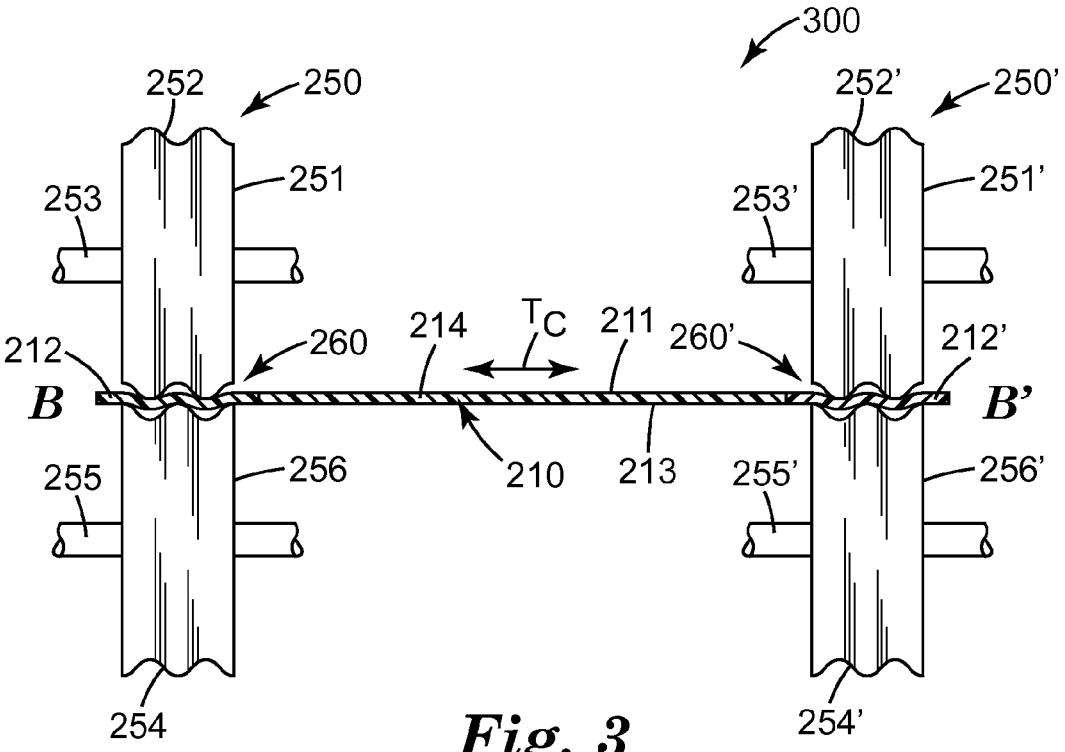
FIG. 3 is a cross-sectional downweb view of a web tensioner.

FIG. 3 is a cross-sectional downweb view of a web tensioner 300 through the section B-B' of the web line 200 of FIG. 2, according to one aspect of the disclosure. The web tensioner 300 includes the web 210 that includes the center portion 214, the first end portion 212 and the second end portion 212' opposite the first end portion 212. In FIG. 3, the first pair of nip rolls 250 and the second pair of nip rolls 250, are shown to be adjacent the first and second end portions 212, 212', respectively. Each of the first and second pairs of nip rolls 250, 250' include a first nip roll 251, 251' having a first corrugated surface 252, 252' on a first surface 211 of web 210. Each of the first and second pairs of nip rolls 250, 250' further includes and a second nip roll 256, 256' having a second corrugated surface 254, 254' on a second surface 213 of web 210. Each of the first nip rolls 251, 251' include a first axis 253, 253', around which the first nip rolls 251, 251' can rotate. Each of the second nip rolls 256, 256' include a second axis 255, 255', around which the second nip rolls 256, 256' can rotate.

In one particular embodiment, each of the first and second nip rolls (251, 251', 256, 256') can be driven nip rolls, that is, an external power source such as a motor (not shown) causes rotation of the nip rolls. In one particular embodiment, each of the first axis 253, 253' and the second axis 255, 255' can be parallel to the crossweb tension $T_C$ direction. In some cases, one or more of the first and second axis (253, 253', 255, 255') can be oriented in a direction that is not parallel to the crossweb tension $T_C$ direction, as described elsewhere.

Each of the first and second pairs of nip rolls 250, 250' at least partially intermesh at a first bending region 260 and a second bending region 260', respectively. The first and second bending regions 260, 260' are regions where the web 210 is constrained in a serpentine path between the partially intermeshing pairs of nip rolls 250, 250', as shown in FIG. 3. Although not wishing to bound by theory, it is believed that the serpentine path of web 210 within first and second bending regions 260, 260' can increase the section modulus of the web 210, and provide the crossweb tension $T_C$ that can serve to reduce the "waviness" (shown in FIG. 1B) of at least the center portion 214 of web 210. In this manner, the center portion 214 of web 210 can remain flat in the tensioning plane.

In one particular embodiment, at least one of the first and second pair of nip rolls 250, 250' can be canted at an angle relative to the tensioning plane defined by the center portion 214 of web 210, to increase the crossweb tension $T_C$. In one particular embodiment, at least one of the first and second pair of nip rolls 250, 250' can be canted at an angle relative to the crossweb tension $T_C$ direction (angled relative to the "x" direction), to increase the crossweb tension $T_C$.

FIGS. 4A-4H are schematic cross-sections of a pair of nip rolls. For brevity, the following description will be directed toward the first pair of nip rolls 250; however, it is to be understood that a similar description applies to the second pair of nip rolls 250' shown in, for example, FIG. 3.

Figure 4A:
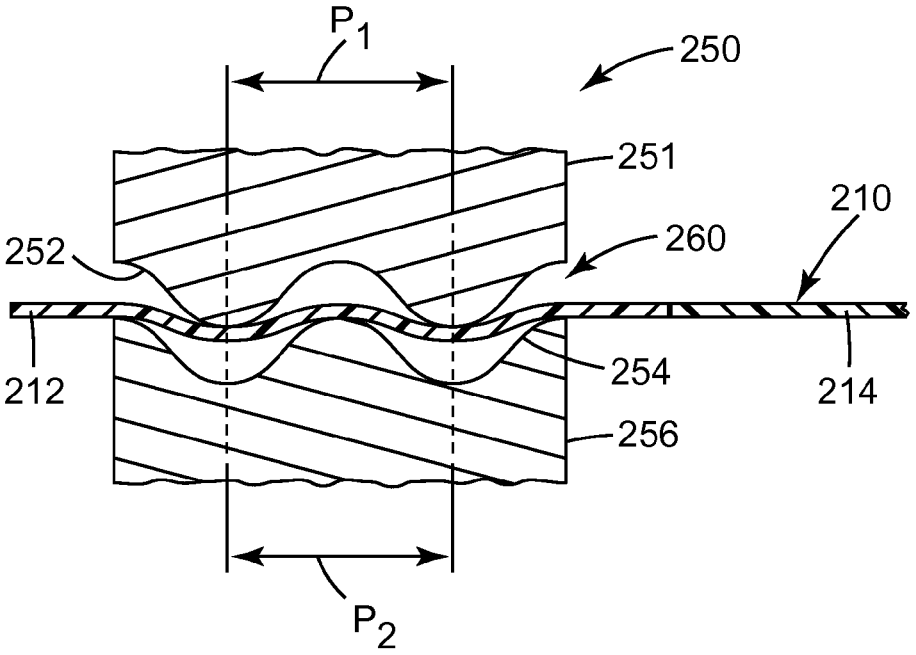
FIGS. 4A-4H are schematic cross-sections of a pair of nip rolls.

FIG. 4A shows a schematic cross-section of a first pair of nip rolls 250 according to one aspect of the disclosure. In FIG. 4A, first pair of nip rolls 250 include a first nip roll 251 that includes a first corrugated surface 252, and a second nip roll 256 that includes a second corrugated surface 254. Each of the first and second corrugated surfaces 252, 254 have sinusoidal corrugations having a first period $P_1$ and a second period $P_2$, respectively. Web 210 includes a center portion 214 and a first edge portion 212, where the first edge portion 212 passes in a serpentine manner through first bending region 260 defined by partially intermeshing first corrugated surface 252 and second corrugated surface 254. In FIG. 4A, first period $P_1$ and second period $P_2$ of corrugations are equal, and first corrugated surface 252 intermeshes with second corrugated surface 254 such that the corrugations are aligned, that is, the first and second periods $P_1$, $P_2$ overlap.

Figure 4B:
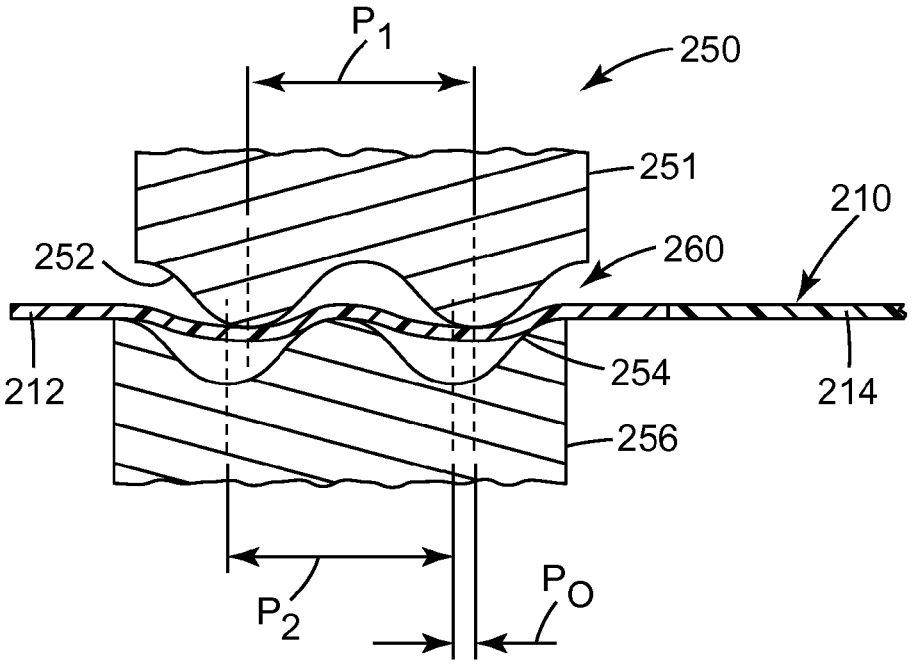

FIG. 4B shows a schematic cross-section of a first pair of nip rolls 250 according to one aspect of the disclosure. Each of the elements 210-260 shown in FIG. 4B correspond to like-numbered elements 210-260 shown in FIG. 4A, which have been described previously. In FIG. 4B, first period $P_1$ and second period $P_2$ of corrugations are equal, and first corrugated surface 252 intermeshes with second corrugated surface 254 such that the corrugations are misaligned, that is, the first and second periods $P_1$, $P_2$ are displaced by a period offset $P_O$. In one particular embodiment, the period offset $P_O$ can be used adjust the crossweb tension $T_C$ described elsewhere. The period offset $P_O$ can be positioned so that the first nip roll 251 is closer to the web center portion 214 as shown in FIG. 4B, or the period offset $P_O$ can be positioned so that the second nip roll 256 is closer to the web center portion 214 (not shown).

Figure 4C:
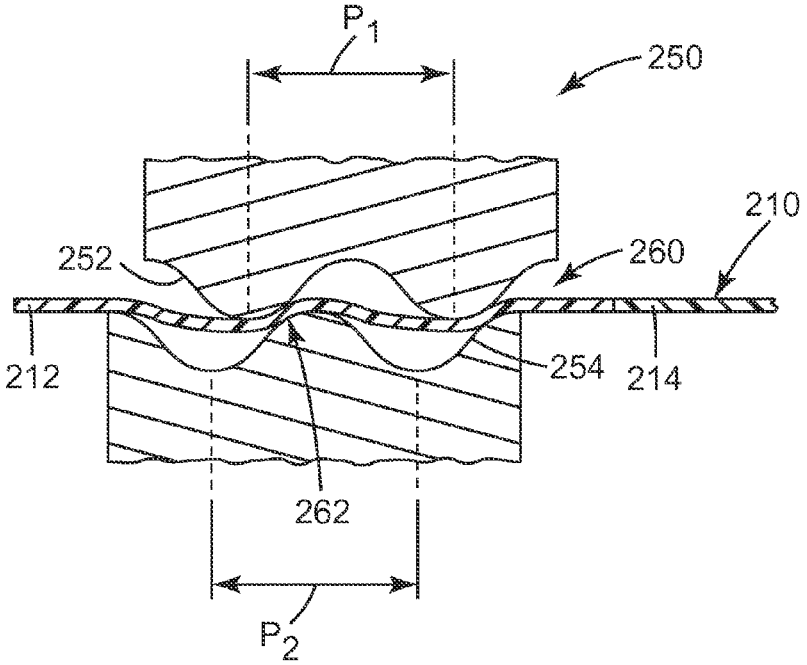

FIG. 4C shows a schematic cross-section of a first pair of nip rolls 250 according to one aspect of the disclosure. Each of the elements 210-260 shown in FIG. 4B correspond to like-numbered elements 210-260 shown in FIG. 4A, which have been described previously. In FIG. 4B, first period $P_1$ and second period $P_2$ of corrugations are equal, and first corrugated surface 252 intermeshes with second corrugated surface 254 such that the corrugations are misaligned, that is, the first and second periods $P_1$, $P_2$ are displaced similar to the embodiment shown in FIG. 4B. In one particular embodiment shown in FIG. 4C, the first and second periods $P_1$, $P_2$ are displaced such that the web 210 is pinched at a pinch point 262. Pinch point 262 can be used to adjust the crossweb tension $T_C$ described elsewhere. The pinch point 262 can be positioned anywhere within bending region 260, as desired.

Figure 4D:
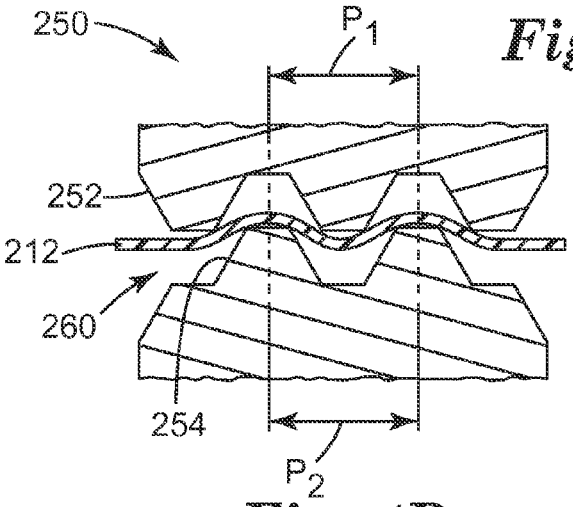

FIG. 4D shows a schematic cross-section of a first pair of nip rolls 250 according to one aspect of the disclosure. In FIG. 4D, first pair of nip rolls 250 includes a first nip roll 251 that includes a first corrugated surface 252, and a second nip roll 256 that includes a second corrugated surface 254. Each of the first and second corrugated surfaces 252, 254 have trapezoidal corrugations having a first period $P_1$ and a second period $P_2$, respectively. Web 210 includes a center portion 214 and a first edge portion 212, where the first edge portion 212 passes in a serpentine manner through first bending region 260 defined by partially intermeshing first corrugated surface 252 and second corrugated surface 254. In FIG. 4D, first period $P_1$ and second period $P_2$ of corrugations are equal, and first corrugated surface 252 intermeshes with second corrugated surface 254 such that the corrugations are aligned, that is, the first and second periods $P_1$, $P_2$ overlap. In one particular embodiment, first corrugated surface 252 can intermesh with second corrugated surface 254 such that the corrugations are misaligned, for example, in a manner similar to that shown in FIGS. 4B-4C.

Figure 4E:
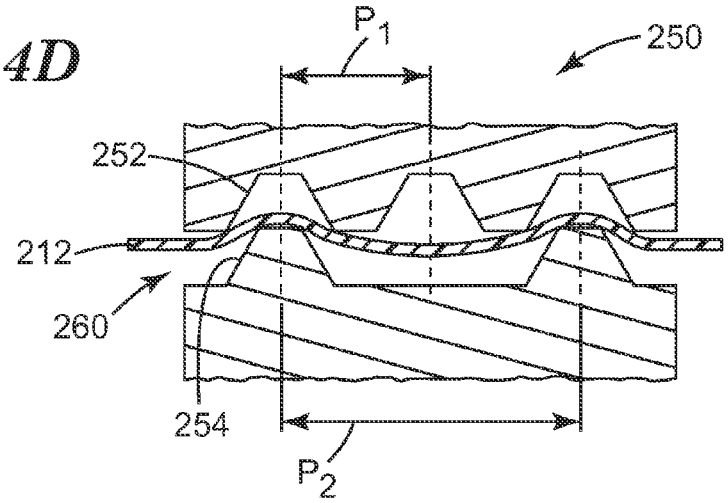

FIG. 4E shows a schematic cross-section of a first pair of nip rolls 250 according to one aspect of the disclosure. Each of the elements 210-260 shown in FIG. 4E correspond to like-numbered elements 210-260 shown in FIG. 4D, which have been described previously. In FIG. 4E, first period $P_1$ and second period $P_2$ of corrugations are not equal, and first corrugated surface 252 intermeshes with second corrugated surface 254 such that a portion of the corrugations are aligned. In one particular embodiment, first corrugated surface 252 can intermesh with second corrugated surface 254 such that a portion of the corrugations are misaligned, for example, in a manner similar to that shown in FIGS. 4B-4C.

Figure 4F:
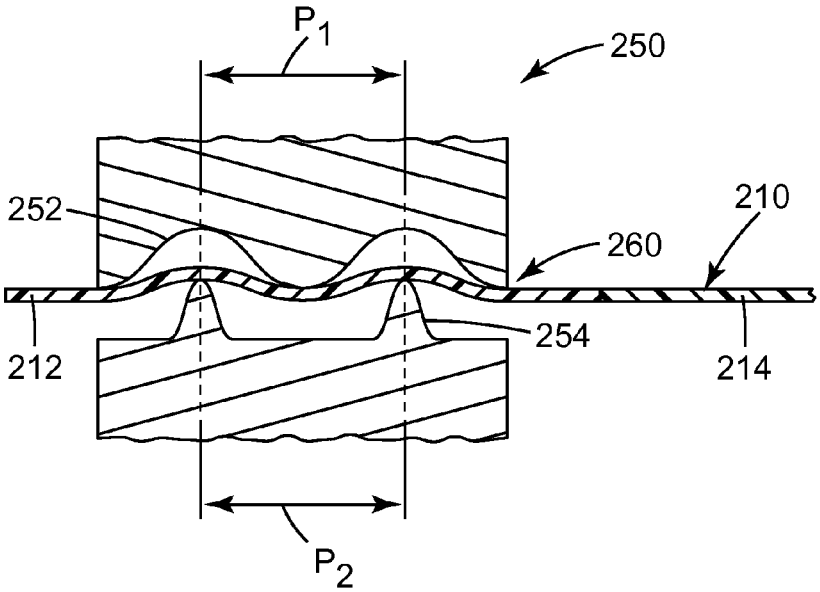

FIG. 4F shows a schematic cross-section of a first pair of nip rolls 250 according to one aspect of the disclosure. In FIG. 4F, first pair of nip rolls 250 include a first nip roll 251 that includes a first corrugated surface 252, and a second nip roll 256 that includes a second corrugated surface 254. Each of the first and second corrugated surfaces 252, 254 have dissimilar shaped corrugations having a first period $P_1$ and a second period $P_2$, respectively. Web 210 includes a center portion 214 and a first edge portion 212, where the first edge portion 212 passes in a serpentine manner through first bending region 260 defined by partially intermeshing first corrugated surface 252 and second corrugated surface 254. In FIG. 4F, first period $P_1$ and second period $P_2$ of corrugations are equal, and first corrugated surface 252 intermeshes with second corrugated surface 254 such that the corrugations are aligned, that is, the first and second periods $P_1$, $P_2$ overlap. In one particular embodiment, first corrugated surface 252 can intermesh with second corrugated surface 254 such that the corrugations are misaligned, for example, in a manner similar to that shown in FIGS. 4B-4C.

Figure 4G:
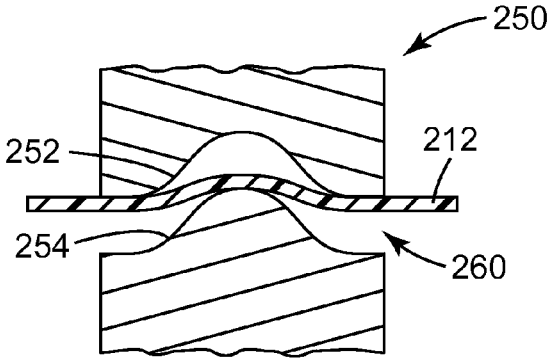

FIG. 4G shows a schematic cross-section of a first pair of nip rolls 250 according to one aspect of the disclosure. In FIG. 4G, first pair of nip rolls 250 includes a first nip roll 251 that includes a first corrugated surface 252, and a second nip roll 256 that includes a second corrugated surface 254. Each of the first and second corrugated surfaces 252, 254 have a single corrugation. Web 210 includes a center portion 214 and a first edge portion 212, where the first edge portion 212 passes in a serpentine manner through first bending region 260 defined by partially intermeshing first corrugated surface 252 and second corrugated surface 254. In FIG. 4G, first corrugated surface 252 intermeshes with second corrugated surface 254 such that the corrugations are aligned. In one particular embodiment, first corrugated surface 252 can intermesh with second corrugated surface 254 such that the corrugations are misaligned, for example, in a manner similar to that shown in FIGS. 4B-4C.

Figure 4H:
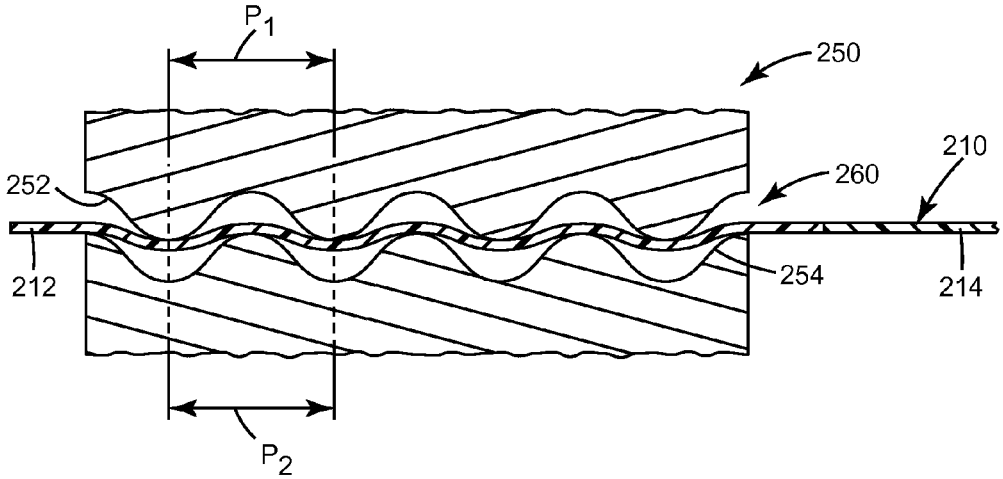

FIG. 4H shows a schematic cross-section of a first pair of nip rolls 250 according to one aspect of the disclosure. In FIG. 4G, first pair of nip rolls 250 includes a first nip roll 251 that includes a first corrugated surface 252, and a second nip roll 256 that includes a second corrugated surface 254. Each of the first and second corrugated surfaces 252, 254 have multiple corrugations, for example, sinusoidal, trapezoidal, dissimilar shaped, or the like, having a first period $P_1$ and a second period $P_2$, respectively. Web 210 includes a center portion 214 and a first edge portion 212, where the first edge portion 212 passes in a serpentine manner through first bending region 260 defined by partially intermeshing first corrugated surface 252 and second corrugated surface 254. In FIG. 4H, first corrugated surface 252 intermeshes with second corrugated surface 254 such that the respective corrugations are aligned, that is, the first and second periods $P_1$, $P_2$ overlap. In one particular embodiment, first corrugated surface 252 can intermesh with second corrugated surface 254 such that the corrugations are misaligned, for example, in a manner similar to that shown in FIGS. 4B-4C.

Figure 5:
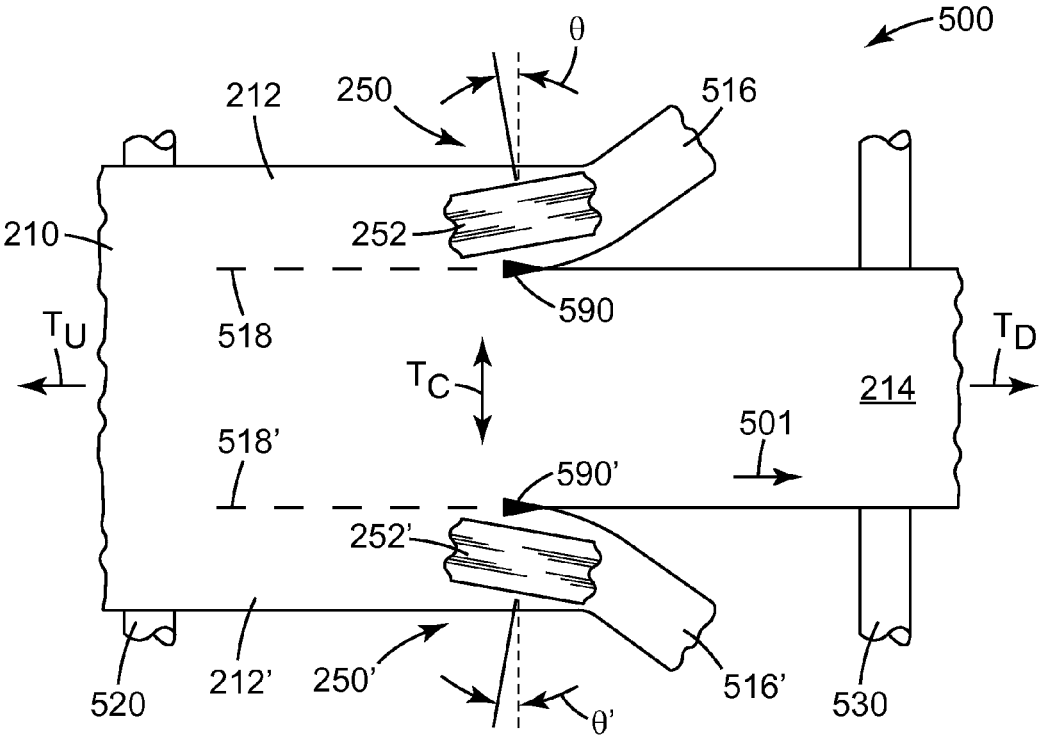
FIG. 5 is a perspective schematic of a web slitter.

FIG. 5 is a perspective schematic of a web slitter 500 according to one aspect of the disclosure. Web slitter 500 includes web 210 having a center portion 214, a first edge portion 212, and a second edge portion 212', moving in downweb direction 501. Web 210 passes over first idler roll 520 and second idler roll 530 and is kept taut by a tension difference between an upweb tension $T_U$, a downweb tension $T_D$, and a crossweb tension $T_C$. The tension difference ($T_D$–$T_U$) is a positive tension, since the web is moving in the downweb direction 501, and $T_D$ must be greater than $T_U$.

Web slitter 500 further includes a first pair of corrugated nip rolls 250 disposed adjacent to the first edge portion 212 and a second pair of corrugated nip rolls 250' disposed adjacent to the second edge portion 212'. In one particular embodiment, a first slitter 590 and a second slitter 590' are disposed on a first and a second cutting line 518, 518', respectively. First and second cutting line 518, 518' separate first and second edge portion 212, 212' from center portion 214, respectively, and first and second slitters 590, 590' sever web 210 along first and second cutting line 518, 518' into first weed 516, center portion 214, and second weed 516'.

First and second pairs of corrugated nip rolls 250, 250' can include any of the corrugated nip rolls described elsewhere in this application. First and second pairs of corrugated nip rolls 250, 250' can be angled or canted at a first and a second angle θ, θ' relative to the crossweb tension $T_C$ direction, as described elsewhere. In one particular embodiment, first and second angle θ, θ' can range from about 0 degrees to about 20 degrees, from about 0 degrees to about 10 degrees, or from about 0 degrees to about 5 degrees.

Figure 6:
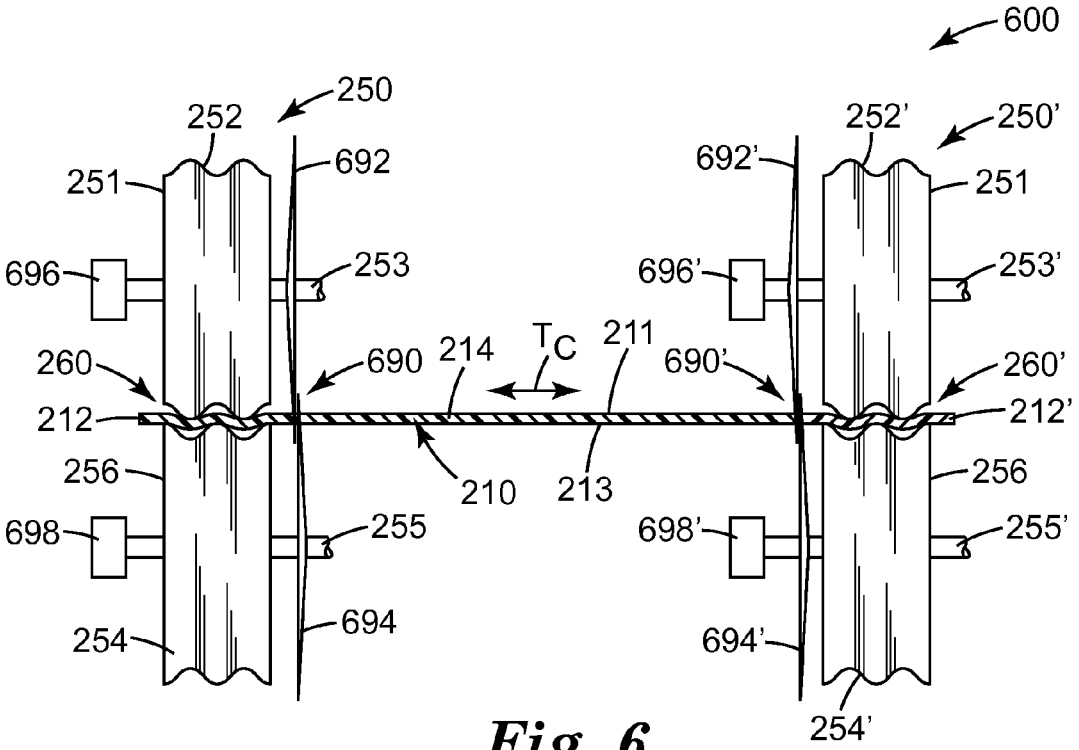
FIG. 6 is a cross-sectional downweb view of a web slitter.

FIG. 6 is a cross-sectional downweb view of a web slitter 600 according to one aspect of the disclosure. FIG. 6 shows a section through the crossweb tension $T_C$ direction in a manner similar to the web tensioner 300 shown in FIG. 3. Each of the elements 210-260 shown in FIG. 6 correspond to like-numbered elements 210-260 shown in FIG. 3, which have been described previously.

The web slitter 600 includes a first slitter 690 disposed to intersect and cut the web 210 between the first edge portion 212 and the center portion 214 of the web 210. The web slitter 600 can also include a second slitter 690' disposed to intersect and cut the web 210 between the second edge portion 212 and the center portion 214 of the web 210. Either one or both of the first and second slitters 690, 690' can be used. In one particular embodiment, both the first and the second slitters 690, 690' can be used, and are known to those of skill in the art, including, for example, knife edges, rotary slitters, laser slitters, waterjet slitters, airjet slitters, and the like, or a combination thereof.

In one particular embodiment, at least one of the first and second slitters 690, 690' can include a pair of circular driven knives (for example, a rotary slitter), an example of which is shown in FIG. 6. First and second slitter 690, 690' includes first circular driven knife 692, 692' and second circular driven knife 694, 694', respectively. Circular driven knife slitters are well known to those of skill in the art.

For brevity, the following description will be directed toward the first pair of nip rolls 250; however, it is to be understood that a similar description applies to the second pair of nip rolls 250' shown in FIG. 6. In one particular embodiment, the first and second nip rolls (251, 256) and the first and second driven knifes (692, 694) can be driven, that is, with a first and a second motor 696, 698. In one particular embodiment (not shown), a single motor can be used to drive the first and second nip rolls (251, 256) and the first and second driven knifes (692, 694), with appropriate gear reductions to control the relative speeds of both the nip rolls and the driven knifes. The motor(s) and gearing (if used) can be disposed closer to the center web portion 214 as shown for the second pair of nip rolls 250', or they can be disposed extending outside of the web 210 as shown for the first pair of nip rolls 250.

Unless otherwise indicated, all numbers expressing feature sizes, amounts, and physical properties used in the specification and claims are to be understood as being modified by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

All references and publications cited herein are expressly incorporated herein by reference in their entirety into this disclosure, except to the extent they may directly contradict this disclosure. Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

What is claimed is:

1. A web tensioner, comprising:

an apparatus for applying a tension in a tensioning plane having a center portion, a first edge portion, a second edge portion opposite the first edge portion, and a tensioning direction perpendicular to both the first edge portion and the second edge portion, comprising:

a first nip wheel having a first axis, having a first corrugated surface adjacent the first edge portion on a first surface of the tensioning plane, the first corrugated surface having a first period along the first axis; and a second nip wheel having a second axis parallel to the first axis, having a second corrugated surface adjacent the first edge portion on a second surface of the tensioning plane opposite the first surface, the second corrugated surface having a second period along the second axis which is displaced along the second axis, relative to the first period along the first axis, by a period offset, wherein the first corrugated surface and the second corrugated surface partially intermesh, and the period offset can be used to adjust the tension in the tensioning direction.

2. The web tensioner of claim 1, wherein each of the first axis and second axis is parallel to the tensioning direction.

3. The web tensioner of claim 2, wherein at least one of the first nip wheel and the second nip wheel are driven to rotate around the first axis and the second axis, respectively.

4. The web tensioner of claim 1, wherein the first corrugated surface and the second corrugated surface each comprise a variation in a radius of the first and second nip wheel, respectively, in the tensioning direction.

5. The web tensioner of claim 1, wherein the first nip wheel has a first maximum outer radius, the second nip wheel has a second maximum outer radius, and at least one of the first maximum outer radius and the second maximum outer radius extends through the tensioning plane.

6. The web tensioner of claim 1, wherein the first corrugated surface and the second corrugated surface each comprise sinusoidal-shaped corrugations, vee-shaped corrugations, trapezoidal-shaped corrugations, or a combination thereof.

7. The web tensioner of claim 1, wherein each of the first corrugated surface and the second corrugated surface have an equivalent period of corrugation.

8. The web tensioner of claim 1, further comprising:

a third nip wheel having a third corrugated surface adjacent the second edge portion on a first surface of the tensioning plane; and a fourth nip wheel having a fourth corrugated surface adjacent the second edge portion on a second surface of the cutting plane opposite the first surface, wherein the third corrugated surface and the fourth corrugated surface at least partially intermesh.

9. The web tensioner of claim 8, wherein the third nip roll has a third axis and the fourth nip roll has a fourth axis, and each of the third axis and fourth axis is parallel to the tensioning direction.

10. The web tensioner of claim 9, wherein at least one of the third nip roll and the fourth nip roll are driven to rotate around the third axis and the fourth axis, respectively.

11. The web tensioner of claim 8, wherein the third corrugated surface and the fourth corrugated surface each comprise a variation in a radius of the third and fourth nip wheel, respectively, in the tensioning direction.

12. The web tensioner of claim 8, wherein the third nip wheel has a third maximum outer radius, the fourth nip wheel has a fourth maximum outer radius, and at least one of the third maximum outer radius and the fourth maximum outer radius extends through the tensioning plane.

13. The web tensioner of claim 8, wherein the third corrugated surface and the fourth corrugated surface each comprise sinusoidal-shaped corrugations, vee-shaped corrugations, trapezoidal-shaped corrugations, or a combination thereof.

14. The web tensioner of claim 8, wherein each of the third corrugated surface and the fourth corrugated surface have an equivalent period of corrugation.

15. The web tensioner of claim 1, wherein the tensioning plane comprises a web.

16. A method of applying lateral tension to a web, comprising:

suspending a web moving in a downweb direction, the web having a center portion, a first edge portion, and a second edge portion opposite the first edge portion;

positioning a first corrugated surface of a first nip wheel adjacent the first edge portion on a first surface of the web, the first nip wheel having a first axis and the first corrugated surface having a first period along the first axis;

positioning a second corrugated surface of a second nip wheel adjacent the first edge portion on a second surface of the web, the second nip wheel having a second axis parallel to the first axis and the second corrugated surface having a second period along the second axis which is displaced along the second axis, relative to the first period along the first axis, by a period offset;

positioning a third corrugated surface of a third nip wheel adjacent the second edge portion on the first surface of the web, the third nip wheel having a third axis;

positioning a fourth corrugated surface of a fourth nip wheel adjacent the second edge portion on the second surface of the web, the fourth nip wheel having a fourth axis parallel to the third axis;

driving at least one of the first nip wheel to rotate about the first axis and the second nip wheel to rotate about the second axis;

driving at least one of the third nip wheel to rotate about the third axis and the fourth nip wheel to rotate about the fourth axis;

partially intermeshing the first corrugated surface with the second corrugated surface and the third corrugated surface with the fourth corrugated surface, thereby applying a lateral tension to the center portion of the web; and adjusting the period offset to adjust the lateral tension.

* * * * *